US008736648B1

(12) United States Patent
Martell

(10) Patent No.: US 8,736,648 B1
(45) Date of Patent: May 27, 2014

(54) VINYL TAPE CARTRIDGE LIFE VALIDATION

(75) Inventor: Robert Martell, Portland, OR (US)

(73) Assignee: Graphic Products, Beaverton, OR (US)

( * ) Notice: Subject to any disclaimer, the term of this patent is extended or adjusted under 35 U.S.C. 154(b) by 434 days.

(21) Appl. No.: 12/907,032

(22) Filed: Oct. 19, 2010

(51) Int. Cl.
*B41J 2/35* (2006.01)

(52) U.S. Cl.
USPC ..... 347/211

(58) Field of Classification Search
USPC ..... 347/171–176, 211, 192; 400/120.01, 400/120.02, 120.03, 120.04, 120.12, 191, 400/196, 219
See application file for complete search history.

(56) References Cited

U.S. PATENT DOCUMENTS

| | | | | |
|---|---|---|---|---|
| 4,440,248 | A | 4/1984 | Teraoka | |
| 4,497,682 | A | 2/1985 | Hamisch | |
| 4,498,947 | A | 2/1985 | Hamisch | |
| 4,501,224 | A | 2/1985 | Shibayama | |
| 4,511,422 | A | 4/1985 | Hamisch | |
| 4,544,434 | A | 10/1985 | Mistyurik | |
| 4,556,442 | A | 12/1985 | Torbeck | |
| 4,584,048 | A | 4/1986 | Hamisch | |
| 4,630,538 | A | 12/1986 | Cushman | |
| 4,655,129 | A | 4/1987 | Wirth | |
| 4,680,078 | A | 7/1987 | Vanderpool | |
| 4,807,177 | A | 2/1989 | Ward | |
| 5,015,324 | A | 5/1991 | Goodwin | |
| 5,078,523 | A | 1/1992 | McGourty | |
| 5,318,370 | A | 6/1994 | Nehowig | |
| 5,372,443 | A | 12/1994 | Borucki | |
| 5,450,116 | A * | 9/1995 | Weiselfish et al. | 347/171 |
| 5,494,365 | A | 2/1996 | Nagae | |
| 5,516,219 | A | 5/1996 | Leonard | |
| 5,672,020 | A | 9/1997 | Leonard | |
| 5,918,989 | A | 7/1999 | Stout | |
| 5,997,194 | A * | 12/1999 | Nunokawa et al. | 400/120.01 |
| 6,215,508 | B1 * | 4/2001 | Bryan et al. | 347/171 |
| 6,232,993 | B1 * | 5/2001 | Kobayashi et al. | 347/175 |
| 6,644,876 | B2 | 11/2003 | Carriere | |
| 8,096,715 | B2 * | 1/2012 | McNestry et al. | 400/120.01 |
| 8,269,808 | B2 * | 9/2012 | Matsutani | 347/171 |
| 2005/0212890 | A1 * | 9/2005 | Kitamura et al. | 347/171 |

OTHER PUBLICATIONS

Maxim Technical Reference 19/4675; Revision 8; Oct. 2009, Maxim 1024-bit, 1-bit Eeprom.

* cited by examiner

*Primary Examiner* — Kristal Feggins
(74) *Attorney, Agent, or Firm* — Applied Logic Patents; Andrew B. Levy

(57) ABSTRACT

A microcontroller, an integrated circuit memory chip, and a data line connection to a microcontroller are the functional elements of a thermal printer vinyl tape cartridge life validation system. A unique, 64 bit, end user company specific identifier is provided from a vendor along with a write zero once integrated circuit device. The write zero once memory chip guarantees that no re-roll of a vinyl tape roll core used in a thermal label printer incorporating this system is possible. The write zero once integrated circuit memory chip is selected for write protection where bits can only be changed from a one to a zero state. The length of a tape roll is represented as a binary number polynomial vector. A length vector is mapped to a count-down register where it will be decremented based on a thermal label printer signal capable of translating tape consumption events into supply length units. There is also a block of relevant supply information representing the supply label characteristics such as color, stock length, type and width. If a unique, 64 bit, end user, company specific identifier matches with a stored copy located in microcontroller ROM, the vinyl tape supply is considered validated and available for use on a thermal label printer incorporating the present invention while the label supply has available life.

11 Claims, 9 Drawing Sheets

VINYL TAPE CARTRIDGE LIFE VALIDATION

CROSS REFERENCES TO RELATED APPLICATIONS

Not Applicable

STATEMENT REGARDING FEDERALLY SPONSORED RESEARCH

Not Applicable

TECHNICAL FIELD

This invention pertains generally to printing or typing equipment involving the use of direct thermal printing or thermal transfer process technology to either transfer a dry film impression to a vinyl tape supply or heat thermal transfer media. More specifically, this invention relates to a cartridge for use in a thermal printing apparatus, the cartridge carrying an integrated circuit memory component which stores information needed by the printing apparatus to determine whether the cartridge is compatible with the printing apparatus and additionally whether supply life remains available. This invention further relates to a printing apparatus incorporating such a cartridge and a method for enabling the use of such a configured cartridge in a thermal printing apparatus.

DESCRIPTION OF THE BACKGROUND ART

There are a number of U.S. patents that disclose electronic apparatus for printing indicia on labels, some are restricted to handheld units and others disclose desktop units. Labeling machines are disclosed, for example in U.S. Pat. Nos. 4,497,682, Hamisch; 4,498,947, Hamisch; 4,501,224, Shibayama; 4,511,422, Hamisch; 4,544,434, Mistyurik; 4,556,442, Torbeck; 4,584,048, Hamisch; 4,630,538, Cushman; 4,680,078, Vanderpool; 4,807,177, Ward; 5,015,324, Goodwin; 5,078,523, McGourty; 5,372,443, Borucki; 5,494,365, Nagae; 5,516,219, Leonard; 5,672,020, Leonard; 5,918,989, Stout; 5,318,370, Nehowig and 6,644,876, Carriere. Various general purpose label printers are described in the following: U.S. Pat. Nos. 4,440,248, Teraoka; 4,501,224, Shibayama; 4,630,538, Cushman; and 4,655,129, Wirth.

The electronic machines for printing labels of the type disclosed above include the same general combination of elements; a print head, a means for feeding labeling media past the print head, a microprocessor, a read only memory programmed with appropriate instructions to operate a microprocessor, a random access memory, a keyboard with letter, number and function keys for the entry of alphanumeric information and instructions concerning the indicia to be printed, and a visual display device such as an LED, LCD or other graphic display unit to assist the operator in using the machine.

Thermal transfer or direct thermal printing uses a heat generating print head to transfer a pigment, such as wax, carbon black, or the like, from a thermal transfer ribbon onto a labeling media such as a vinyl tape supply and/or heat the print media. By using digital technology, characters, symbols or shapes are formed upon energizing a sequence of pins on the print head which in turn melt the wax or other pigment on the ribbon transferring the image to the labeling media supply and/or heat the print media.

The labeling media supply comprises either a continuous strip, a laser die cut series of labels attached to a carrier strip or other similar format. The labels are then removed from the carrier and attached to the objects needing identification. As there are many types of labeling applications, there are many combinations of labels and carrier strips that provide labels of varying sizes, colors, and formats. Many label printers are designed for printing on label media that meets certain physical criteria for end use. An operator has no way of reliably knowing whether the labeling media is compatible with the particular printer and if it meets the printer manufacturer's operating specifications. A mismatch between the labeling media and the print head's energy level within the printing apparatus may result in poor print quality or even damage to the printing apparatus.

Methods are known in the art that address the problem of using incompatible labeling media. One approach is to provide an adjustable platen for a label printer which accommodates media of widely different widths and thicknesses as disclosed by U.S. Pat. No. 5,372,443, Borucki et al. These mechanical measures are not helpful in differentiating print media designed for use in thermal printers. In U.S. Pat. No. 5,318,370, Nehowig teaches a thermal printing machine with a tape cassette including a memory circuit with two separate memory areas where an algorithm provides validation. The present invention removes the unnecessary step of requiring an algorithm to encrypt, encode, decode and decrypt a test number pattern using two memory locations to determine a cartridge's validity. In U.S. Pat. No. 5,918,989, Stout teaches a handheld labeler where a spool contains a memory chip which stores information about the print media where this information is conveyed to the printer through concentric electrical contacts on the end of the spool. The concentric electrical contacts engage stationary contacts on the printer wherein the electrical contact connection is insensitive to incidental rotation. The present invention does not necessitate any concentric or any other specific type of electrical contact connector. In U.S. Pat. No. 6,644,876, Carriere teaches a method and apparatus for printer cartridge identification where the identification circuit is triggered by an electrical connection between a printed circuit board coupled to the cartridge and a plurality of spring contacts in a cartridge receptacle in the printer. The present invention does not require or use spring contacts which may suffer from both expense or premature wear and fatigue of springs at the point of insertion.

ADVANTAGES OF THE PRESENT INVENTION

The present invention has numerous advantages in the art of vinyl tape supply validation. One advantage is that the number of steps required for the validation of a vinyl tape supply is reduced by the removal of encryption and subsequent decryption of a unique end user company specific identifier as well as the unnecessary requirement of an extra memory location to store the encryption. The validation scheme of the present invention simply checks for a matching unique end user company specific identifier. Another advantage of the present invention is the capability of having a power loss recovery scheme where backup information is maintained in an alternate register set where supply life information may be recalled from the alternate register set containing the prior supply life information status. When a power loss results in an incomplete write of the register set, a register validity bit does not update. The vinyl tape supply life stored contents will revert to the state of the previous valid contents. A third advantage of the present invention is that a simple, flexible and extensible method is provided for updating a supply life polynomial vector which is capable of adjustment to meet specific printer supply requirements.

SUMMARY OF THE INVENTION

The present invention is a system for validating a thermal printer vinyl tape cartridge to ascertain the remaining useful material supply life. More particularly, the system includes the following: a microcontroller, a Maxim DS2431 integrated circuit memory chip, similar integrated circuit chip or field programmable array device, and a data line connection with the microcontroller. A unique sixty four bit, end user, company specific identifier is provided by the vendor on an integrated circuit memory chip. The write zero once integrated circuit memory chip guarantees that no refill of a consumed vinyl tape roll cartridge or core used in a thermal label printer containing the described invention is possible. The integrated circuit memory chip has four memory pages of two hundred and fifty six bits. Each thirty two bit register bank has a write zero once capability. The length of a tape roll is represented as a binary number polynomial. A length vector is mapped to a count-down register where it will be decremented based on a thermal label printer message signaling tape consumption in variable unit increments. Bank registers zero or one may be used for power loss recovery. This is an advantageous feature to be able to recover appropriately upon a power loss. There is also a block of relevant supply information representing label supply characteristic parameters such as but not limited to color, length, and stock type. The data line connection between the Maxim integrated circuit memory chip or similar write zero once integrated circuit memory chip with a representative microcontroller may be either a wired serial or a wireless link using a wireless communication protocol, such as RFID technology.

The principle behind this invention is to have an economic, simple and effective means to validate a thermal label supply to ensure that a supply has not been tampered or rerolled with non-factory authorized material and to avoid the unnecessary complication and overhead of any encryption scheme. A Maxim DS2431 or like write zero once integrated circuit memory chip is provided along with a unique sixty four bit end user company specific identifier whose match verifies the validity of a vinyl tape supply with respect to a stored copy within the representative microcontroller. A supply life vector is written to a write zero once count-down register. The supply life vector, binary number polynomial represents the currently available supply length. The thermal label printer apparatus maintains a counter representing the amount of label supply consumed. Supply specific distance units are represented as bits in the write zero once count-down register. The supply life vector is decremented when a consumption message is received over the data connection wherein the message represents a variable unit of supply consumption.

A representative example of a sixty four bit, supply life vector showing amount of remaining vinyl tape supply life is described in the following table, as a binary number polynomial, hexadecimal value, length in units of hundredths of inches and feet. However other variations of the following in a multiplicity of combinations are possible so as not to limit the scope of the present invention.

| Binary Number Polynomial | Hex Value | Length in Hundredths of Inches | Length in Hundredths of Feet |
|---|---|---|---|
| 0 | 0 | 0 | 0 |
| $2^8$ | 0x100 | 2.56 | 0.21 |
| $2^9+2^8$ | 0x300 | 7.68 | 0.64 |
| $2^{10}+2^9+2^8$ | 0x700 | 17.92 | 1.49 |
| $2^{11}+2^{10}+2^9+2^8$ | 0xf00 | 38.40 | 3.20 |
| $2^{12}+2^{11}+2^{10}+2^9+2^8$ | 0x1f00 | 79.36 | 6.61 |
| $2^{13}+2^{12}+2^{11}+2^{10}+2^9+2^8$ | 0x3f00 | 161.28 | 13.44 |
| $2^{14}+2^{13}+2^{12}+2^{11}+2^{10}+2^9+2^8$ | 0x7f00 | 325.12 | 27.09 |
| $2^{15}+2^{14}+2^{13}+2^{12}+2^{11}+2^{10}+2^9+2^8$ | 0xff00 | 652.80 | 54.40 |
| $2^{16}+2^{15}+2^{14}+2^{13}+2^{12}+2^{11}+2^{10}+2^9+2^8$ | 0x1ff00 | 1308.16 | 109.01 |
| $2^{17}+2^{16}+2^{15}+2^{14}+2^{13}+2^{12}+2^{11}+2^{10}+2^9+2^8$ | 0x3ff00 | 2618.88 | 218.24 |
| $2^{18}+2^{17}+2^{16}+2^{15}+2^{14}+2^{13}+2^{12}+2^{11}+2^{10}+2^9+2^8$ | 0x7ff00 | 5240.32 | 436.69 |

The foregoing and other objects and advantages of the present invention will appear from the following description. Reference is made to the accompanying drawings which form a part of the description and show a preferred embodiment of the invention. Such embodiment does not necessarily represent the full scope of the invention, however and reference is made to the claims for interpreting the scope of the invention.

DESCRIPTION OF THE PREFERRED EMBODIMENTS

Figure 1:
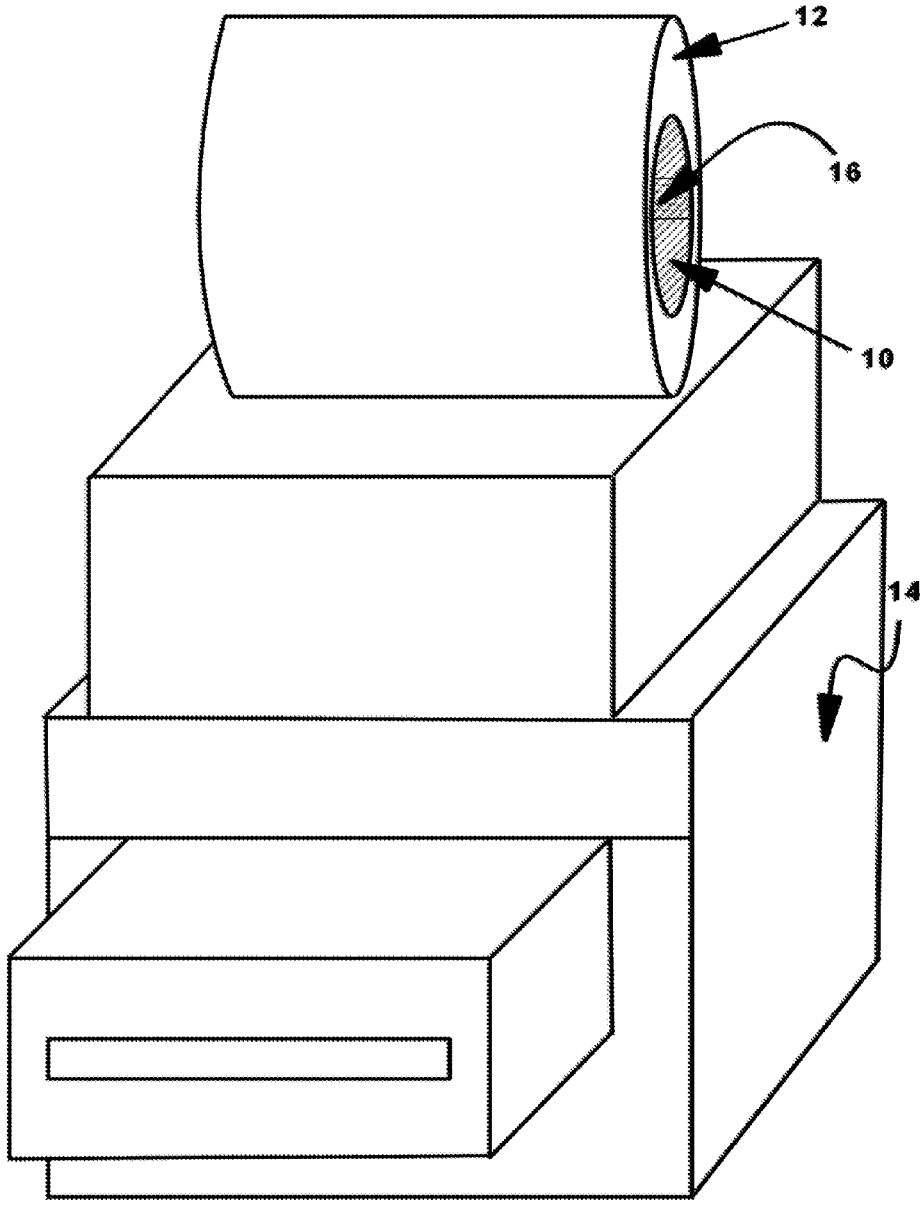
FIG. 1 is a perspective view of a thermal or direct transfer label printer and supply employing the present invention.
Figure 2:
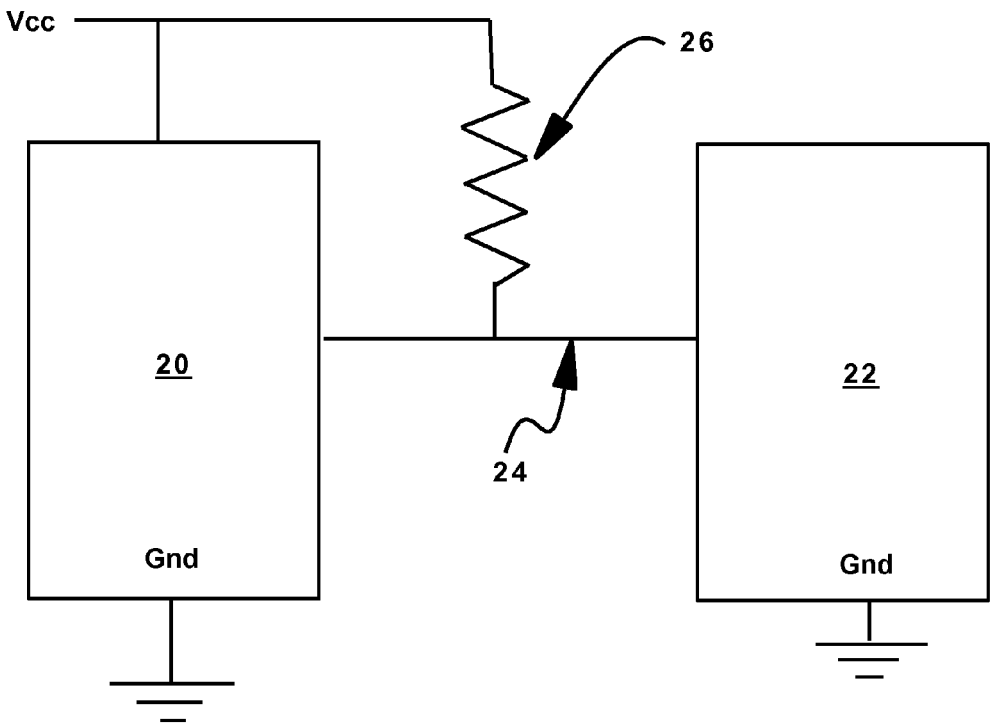
FIG. 2 is an electrical block diagram of the printer microcontroller, with a write zero once integrated memory chip and data line connection.

Referring to FIGS. 1 and 2, a printing apparatus 14 employs the present invention which includes a vinyl tape roll core 10. Upon the vinyl tape roll core 10, a vinyl tape roll supply 12 is rolled. The vinyl tape roll core 10 interior cavity further serves to house an integrated circuit memory chip holder 16 located within close physical proximity to the printer micro-controller 20. The printer micro-controller 20 is connected to a Maxim DS2341 1024-bit, 1-wire eeprom or like write zero once integrated circuit memory chip 22. The printer micro-controller 20 and write zero once integrated circuit memory chip 22 are connected by a data line connection 24. Pull up resistor 26 is connected between the data line connection 24 and a Vcc voltage level.

Figure 3:
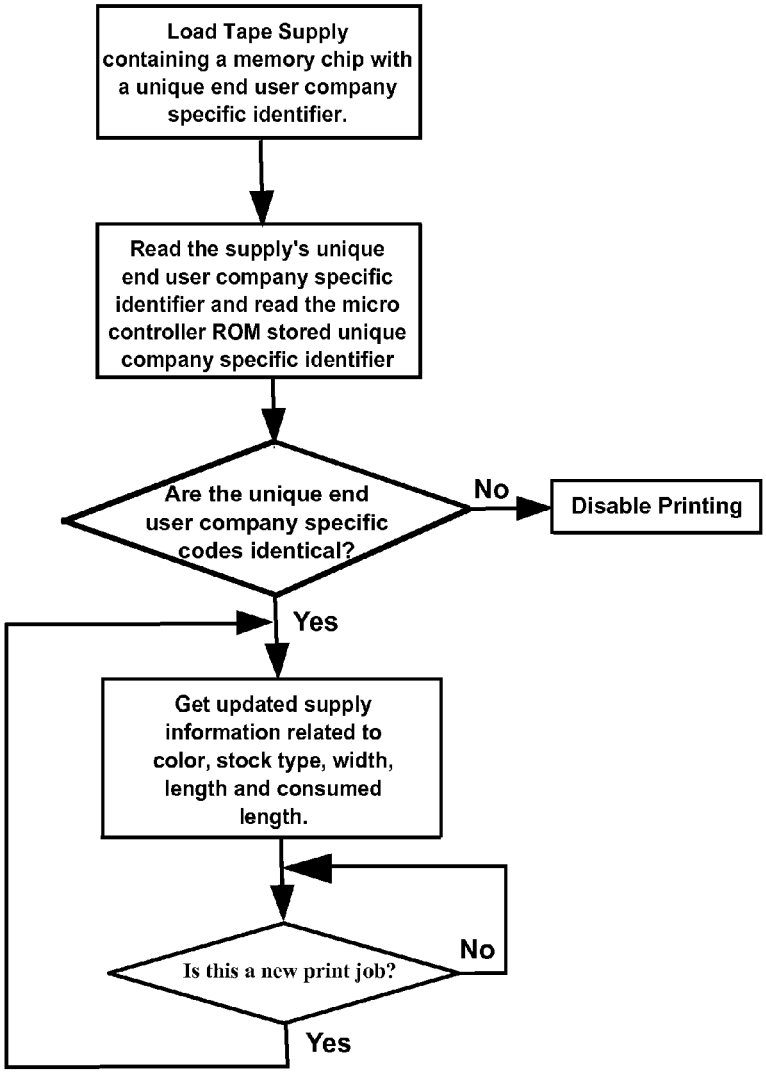
FIG. 3 is a flowchart illustrating the sequence of operations involved in validating a supply label and accessing supply information.

FIG. 3 illustrates, in flowchart form, the use of a write zero once memory circuit component to enable a printer apparatus as described above. This flowchart describes the steps that take place in the validation of a thermal printer label supply. The unique end user company specific identifier is initially validated. At the time that a new print job arrives, the information stored on the write zero once integrated circuit memory chip 22 is read.

Figure 4:
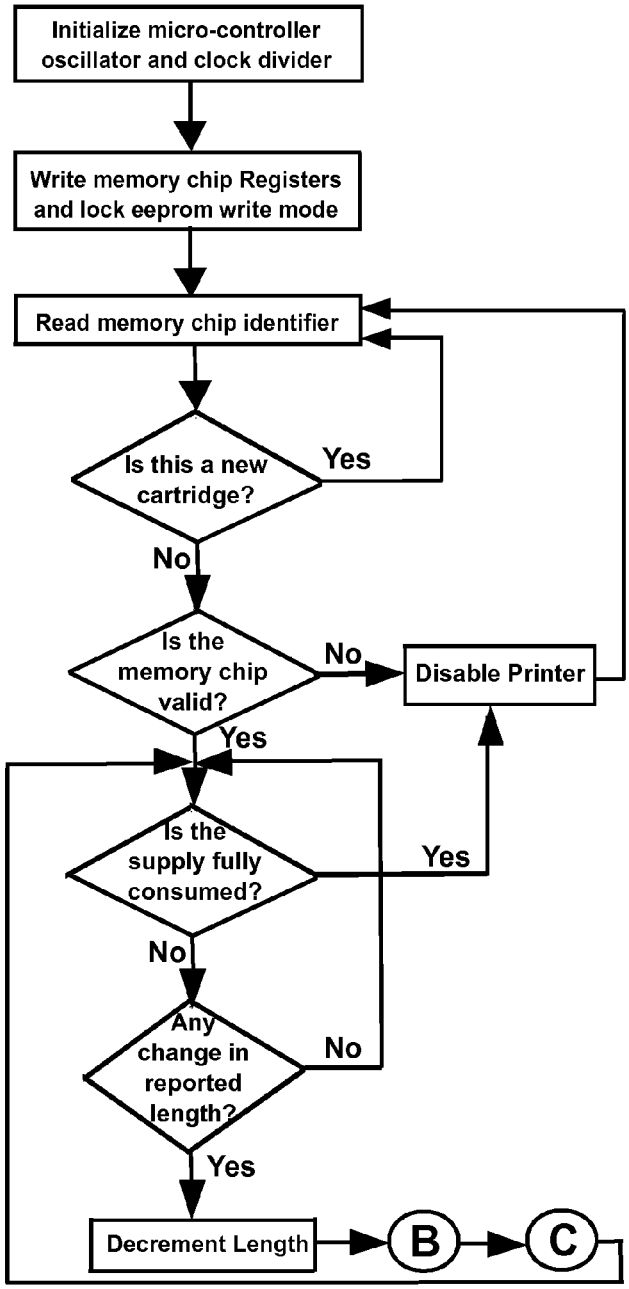
FIG. 4 is a detailed flowchart illustrating the algorithm for writing supply life information to the integrated circuit memory chip.
Figure 5:
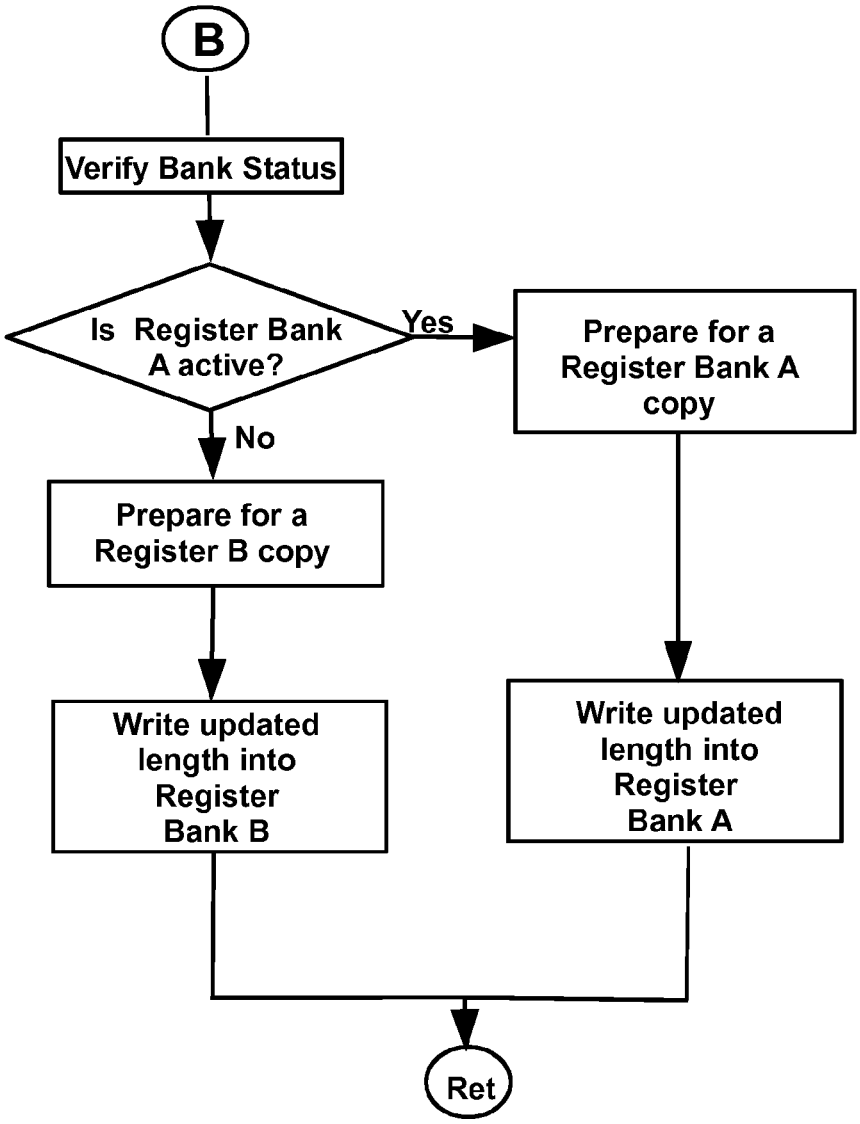
FIG. 5 is a detailed flowchart illustrating the step of verifying the write zero once integrated circuit memory chip's register bank status and writing to memory registers of the write zero once integrated circuit memory chip.
Figure 6:
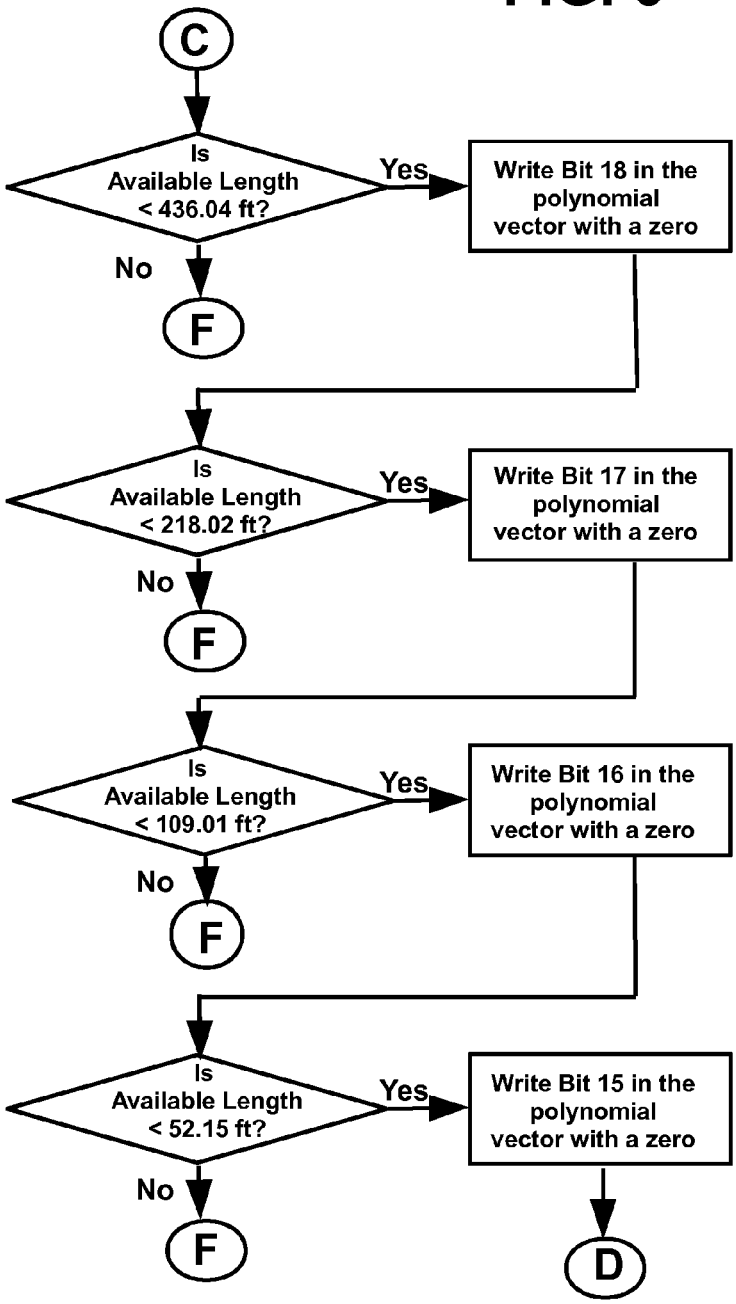
FIG. 6 is a detailed flowchart illustrating the step of determining an available tape length in the range of greater than around 436.69 feet to around 54.40 feet.

FIG. 4 illustrates, in flowchart form, the sequence of steps involved in the initialization of the micro-controller 20, by writing to the register set of the write zero once integrated circuit memory chip 22, by verifying that the write zero once memory chip 22 is a Maxim DS2341 or like integrated circuit chip, by detecting any change in the available supply length. In the event that no Maxim DS2341 write zero once integrated circuit memory or like chip 22 is detected then the printing apparatus 14 is disabled. In the event that a change in reported length is observed then the next sequential operation is represented in FIGS. 5 and 6. The writable register set is updated accordingly.

FIG. 5 illustrates, in flowchart form, the sequence of steps required to recover from a potential loss of power such as that due to the removal of the vinyl tape roll 12 resulting in an incomplete transfer of information to the write zero once integrated circuit memory chip 22. Two active register banks are maintained to provide a back up capability for a loss of power event. A bank register valid bit indicator is maintained within the write zero once integrated circuit memory chip to mark the currently active register bank. If an incomplete write zero once integrated circuit memory chip 22 write sequence occurs due to a power loss or a removal of a vinyl tape supply roll 12, then the active register bank reverts to the last valid register bank. This reversion behavior restores the available vinyl tape supply length to the last saved available length value. The current active register bank is prepared for a bank copy operation. This preparation involves writing to the appropriate register set. An active bank register 0 will write to the main register set while an active bank register 1 will write to an alternate register set within write zero once integrated circuit memory chip 22.

Figure 7:
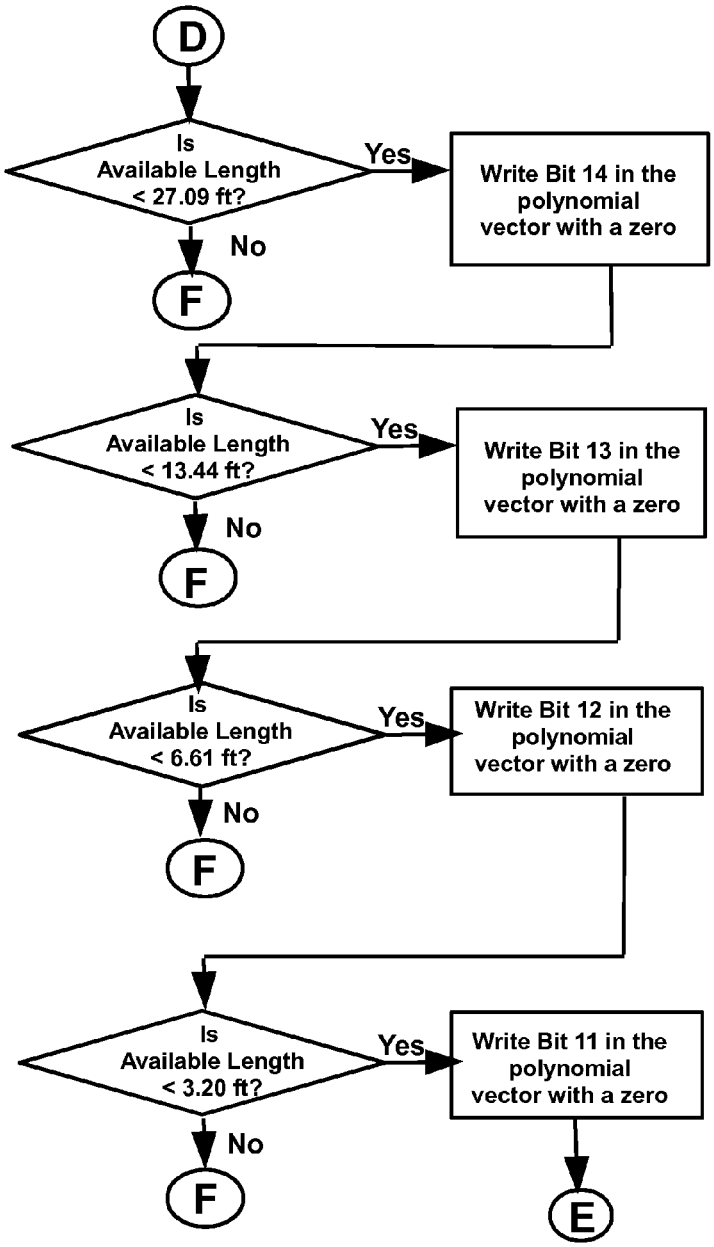
FIG. 7 is a detailed flowchart illustrating the step of determining an available tape length in the range of below around 54.40 feet to around 3.20 feet.
Figure 8:
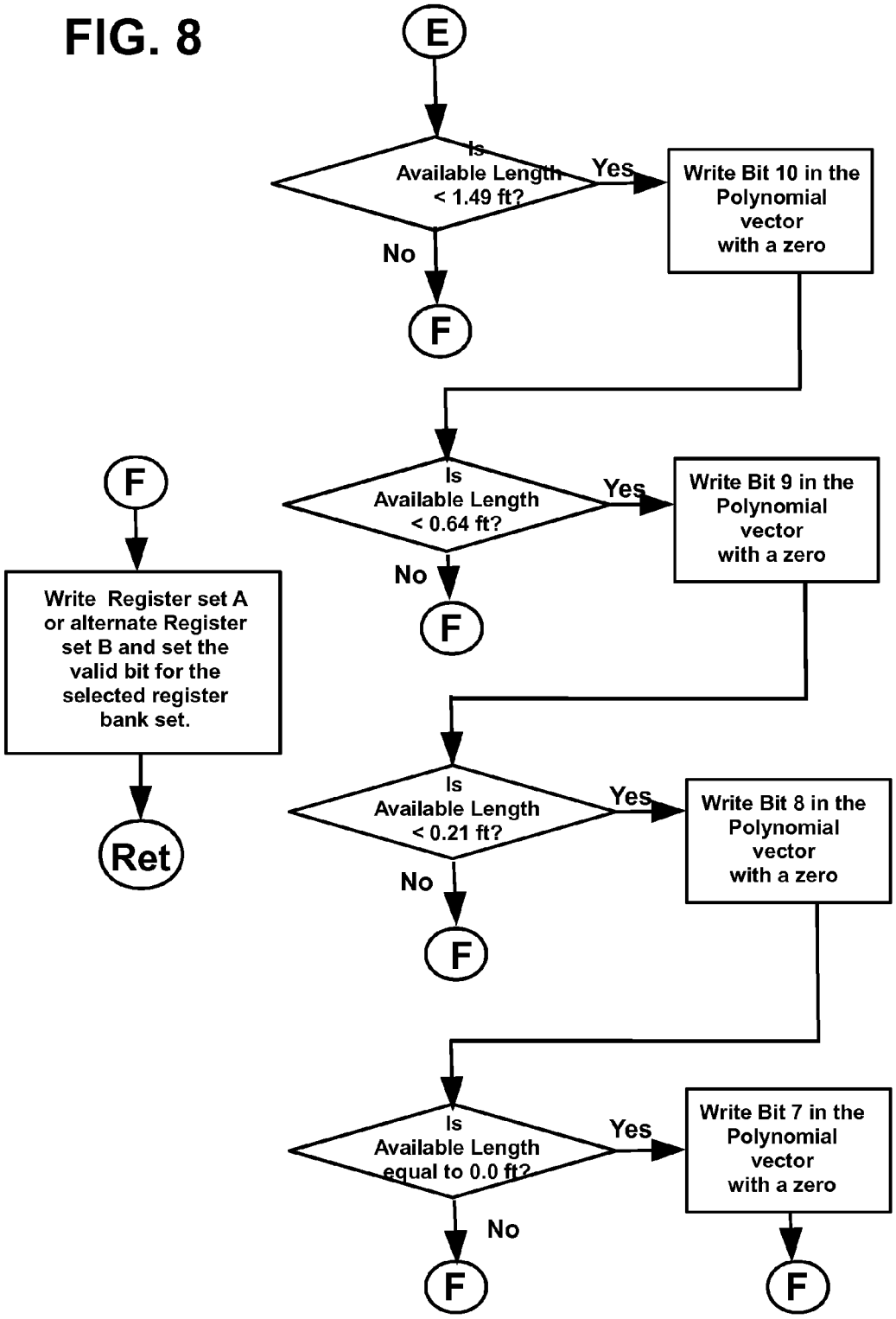
FIG. 8 is a detailed flowchart illustrating the step of determining an available tape length of in the range of below around 3.20 feet to around 0 feet.

FIGS. 6, 7 and 8 illustrate, in flowchart form how the available tape length polynomial vector is formed. At the time of manufacture, the vinyl tape supply roll 12 is loaded with an appropriate end user company specific identifier and an initial length value vector reflecting the actual vinyl tape supply roll 12 length. A sixty four bit supply length polynomial is understood according to the details described in the referenced flowcharts. As an example suppose that the initial length of the supply is four hundred and forty feet. The 64 bit supply length binary polynomial is pre-loaded with bits 18 through 7 inclusive set to 1 and all of the other bits set to 0. After some amount of vinyl tape supply consumption, the supply length of the vinyl tape supply roll 12 is below 436.69 feet and above 218.24 feet. As a result, bit 18 of the sixty four bit supply length polynomial is set to a 0 value. From FIG. 6, it is determined that the available length is not less than 218.24 feet and processing flow control transfers to label F of FIG. 8. The registers and valid bit for the selected register bank are written onto integrated circuit memory chip 22. In a similar fashion other lengths of available vinyl tape supply length are in ranges of near 5240.32 to 2618.88 inches, near 2618.88 to 1308.16 inches, near 1308.16 to 652.80 inches, near 652.80 to 325.12 inches, near 325.12 to 161.28 inches, near 161.28 to 79.36 inches, near 79.36 to 38.40 inches, near 38.40 to 17.92 inches, near 17.92 to 7.68 inches, near 7.68 to 2.56 inches and below 2.56 inches are recorded.

Figure 9:
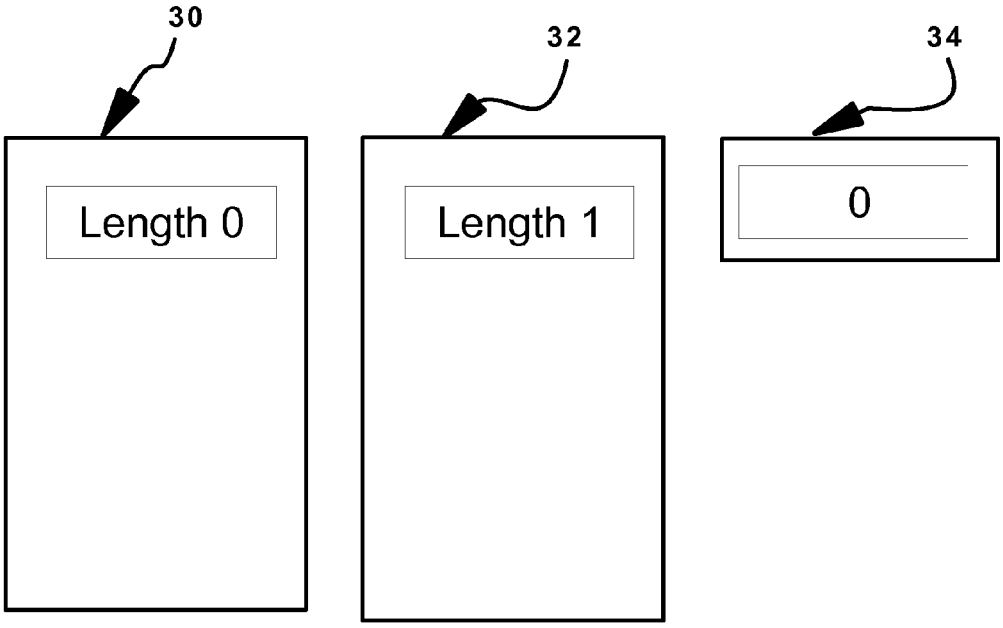
FIG. 9 is a block diagram showing two sets of register banks with a register bank selector to expedite recovery of supply life information after encountering an incomplete write caused by a power loss.

FIG. 9 is a block diagram detailing two alternate register banks A and B and a register selector. Register bank A 30 refers to the main register bank. Register bank B 32 refers to the alternate register bank. Register selector 34 holds the value of the currently selected register bank where a value of 0 indicates that register bank A is selected and a value of 1 indicates that register bank B is selected. In the event of a loss of power such as when a battery discharges, a power supply is disconnected or other power failure occurs, the write operation to the currently selected register bank may not complete wherein the register selector 34 is not updated. The end user company specific identified write zero once integrated circuit chip will only be updated when a successful write operation is completed wherein the register selector 32 maintains the most recently updated register bank information.

It is to be understood that even though numerous characteristics and advantages of the present invention have been set forth in the foregoing description, together with details of the structure and function of the invention, this disclosure is illustrative only, and changes may be made in detail, especially in matters of content, quantities, and arrangement of constituent elements, within the principles of the invention to the full extent indicated by the broad general meaning of the terms in which the appended claims are expressed.

I claim:

1. A device for validating authenticity and updating the supply life for a thermal printer vinyl tape supply located within a thermal printer, the combination comprising:

a vinyl tape supply core extending through an opening enabling said thermal print media to unwind about a cartridge, core or like adaptor axis as said thermal print media is consumed by said thermal printer;

a microcontroller residing within said thermal printer;

a memory chip means;

a data connection means;

an electrical power means;

an integrated circuit chip validating means;

an error checking means;

a supply life means;

a thermal print head means;

and a write zero once memory chip bank selection means.

2. The device as recited in claim 1, wherein said electrical power means is adapted to supply the electrical power required by the device through a wall power adapter or battery power means.

3. The device as recited in claim 1, wherein said memory chip means comprises a write zero once integrated circuit memory device holding a unique sixty four bit end user company specific identifier, a block of supply information, a polynomial count-down register and a supply consumption counter.

4. The device as recited in claim 1, wherein said supply life means writes a supply life polynomial vector to a count-down register in write zero once memory and maintains proper length of a supply consumption counter.

5. The device as recited in claim 1, wherein said integrated circuit chip validating means validates a unique sixty four bit manufacturer identifier.

6. The device as recited in claim 1, wherein said data connection means is a channel for coupling said microcontroller with a write zero once integrated circuit memory device as one of the following; a serial wired connection or a wireless technology such as a radio frequency, near-field or other similar communication protocol.

7. The device as recited in claim 1, wherein said zero write once memory chip bank selection means selects the current length of supply or restores the last valid length of supply given the possibility of device loss of power, removal of vinyl tape roll supply or other exceptional condition.

8. The device as recited in claim 1, wherein said thermal print head means is energized in response to signals from a printing device circuit.

9. The device as recited in claim 1, wherein said supply life polynomial vector represents accelerated supply available lengths according the following:

Bits 8, 9, 10, 11, 12, 13, 14, 15, 16, 17 and 18 all set to a one value with all other bits set equal to zero within the sixty four bit vector represents 5240.32 inches;

Bits 8, 9, 10, 11, 12, 13, 14, 15, 16 and 17 all set to a one value with all other bits set equal to zero within the sixty four bit vector represents 2618.88 inches;

Bits 8, 9, 10, 11, 12, 13, 14, 15 and 16 all set to a one value with all other bits set equal to zero within the sixty four bit vector represents 1308.16 inches;

Bits 8, 9, 10, 11, 12, 13, 14 and 15 all set to a one value with all other bits set equal to zero within the sixty four bit vector represents 652.80 inches;

Bits 8, 9, 10, 11, 12, 13 and 14 all set to a one value with all other bits set equal to zero within the 64 bit vector represents 325.12 inches;

Bits 8, 9, 10, 11, 12 and 13 all set to a one value with all other bits set equal to zero within the sixty four bit vector represents 161.02 inches;

Bits 8, 9, 10, 11 and 12 set to a one value with all other bits set equal to zero within the sixty four bit vector represents 79.36 inches;

Bits 8, 9, 10 and 11 all set to a one value with all other bits set equal to zero within the sixty four bit vector represents 38.40 inches;

Bits 8, 9 and 10 all set to a one value with all other bits set equal to zero within the sixty four bit vector represents 17.92 inches;

Bits 8 and 9 set to a one value with all other bits set equal to zero within the sixty four bit vector represents 7.68 inches;

and Bit 8 set to a one value with all other bits set equal to zero within the sixty four bit vector represents 2.56 inches.

10. A method of using a device for validating a thermal printer vinyl supply located within a thermal printer, the combination comprising:

a vinyl supply core extending through an opening wherein said vinyl tape supply core, cartridge or like adaptor enables said thermal print media to unwind about said vinyl tape supply core, cartridge or like adaptor axis as said thermal print media is consumed by said thermal printer;

a microcontroller residing within said thermal printer for validating a unique sixty four bit end user company specific identifier, furthermore computing a cyclic redundancy check on a block of supply information data, and writing a vinyl tape supply vector to a polynomial count-down register in write zero once memory and maintaining a length of supply consumption counter;

a write zero once integrated circuit memory device for holding a unique sixty four bit end user company specific identifier, holding a block of supply information, holding a polynomial count-down register and length of supply consumption counter;

a data connection for coupling the microprocessor and said write zero once or like integrated circuit memory device;

a printing device having a thermal print head energized in response to signals from a printing device circuit;

and having a facility for storing the last valid supply length maintained by selection of the bank register pair in the event of power loss or removal of the vinyl tape roll supply.

11. A method of using a device for validating a thermal printer vinyl tape roll supply located within a thermal printer, wherein said supply life binary polynomial vector represents accelerated supply available lengths according the following:

Bits 8, 9, 10, 11, 12, 13, 14, 15, 16, 17 and 18 all set to a one value with all other bits set equal to zero within the sixty four bit vector represents 5232.64 inches;

Bits 8, 9, 10, 11, 12, 13, 14, 15, 16 and 17 all set to a one value with all other bits set equal to zero within the sixty four bit vector represents 2616.32 inches;

Bits 8, 9, 10, 11, 12, 13, 14, 15 and 16 all set to a one value with all other bits set equal to zero within the sixty four bit vector represents 1302.16 inches;

Bits 8, 9, 10, 11, 12, 13, 14 and 15 all set to a one value with all other bits set equal to zero within the sixty four bit vector represents 652.80 inches;

Bits 8, 9, 10, 11, 12, 13 and 14 all set to a one value with all other bits set equal to zero within the sixty four bit vector represents 325.12 inches;

Bits 8, 9, 10, 11, 12 and 13 all set to a one value with all other bits set equal to zero within the sixty four bit vector represents 161.28 inches;

Bits 8, 9, 10, 11 and 12 set to a one value with all other bits set equal to zero within the sixty four bit vector represents 79.36 inches;

Bits 8, 9, 10 and 11 all set to a one value with all other bits set equal to zero within the sixty four bit vector represents 38.40 inches;

Bits 8, 9 and 10 all set to a one value with all other bits set equal to zero within the sixty four bit vector represents 17.92 inches;

Bits 8 and 9 set to a one value with all other bits set equal to zero within the sixty four bit vector represents 7.68 inches;

and Bit 8 set to a one value with all other bits set equal to zero within the sixty four bit vector represents 2.56 inches.

* * * * *